United States Patent [19]

Zimmerman

[11] 4,328,866

[45] May 11, 1982

[54] CHECK VALVE ASSEMBLY

[75] Inventor: John C. Zimmerman, Duncan, Okla.

[73] Assignee: Halliburton Company, Duncan, Okla.

[21] Appl. No.: 128,324

[22] Filed: Mar. 7, 1980

[51] Int. Cl.[3] ..... E21B 34/06

[52] U.S. Cl. ..... 166/317; 166/326

[58] Field of Search ..... 166/317, 319, 326, 264, 166/184

[56] References Cited

U.S. PATENT DOCUMENTS

| | | | |
|---|---|---|---|
| 1,854,518 | 4/1932 | Little | 166/326 |
| 3,193,016 | 7/1965 | Knox | 166/184 |
| 3,850,250 | 11/1974 | Holden et al. | 166/317 |
| 4,063,593 | 12/1977 | Jessup | 166/317 |
| 4,064,937 | 12/1977 | Bannington | 166/317 |
| 4,113,012 | 9/1978 | Evans | 166/321 |

*Primary Examiner*—James A. Leppink

*Attorney, Agent, or Firm*—John H. Tregoning; James R. Duzan

[57] ABSTRACT

An improved check valve assembly for use in a well bore comprising an outer annular housing, sliding mandrel slidably disposed within the bore of the outer annular housing, check valve seal means retained on the exterior of the outer annular housing and shear means disposed within the outer annular housing having a portion engaging the sliding mandrel and the outer annular housing.

26 Claims, 5 Drawing Figures

CHECK VALVE ASSEMBLY

BACKGROUND OF THE INVENTION

This invention relates to an improved apparatus for use with a tubing string used in conducting drill stem tests of oil and gas wells. More particularly, the apparatus relates to a check valve apparatus allowing trapped fluid to flow from the interior of the test string to the well annulus when the test string is being lowered in a well bore into sealing engagement with a wireline set production packer.

During the drilling of oil and gas wells, various types of drilling fluids known as muds are used to maintain formation fluids in intersected formations by virtue of their hydrostatic pressure. In order to allow the formation fluids to flow to the surface for analysis, it is necessary to isolate the formation to be tested from the hydrostatic pressure of the drilling fluid in the well bore. This is done by lowering a tubular pipe string comprising testing tools and piping or testing string, as it is commonly known, to the formation to be tested, then sealing the well annulus between the testing string and above the formation with a packer.

Typically, a tester valve is included at the lower end of the testing string and is lowered in the closed condition such that a lower pressure exists in the bore of the testing string. After the formation is isolated from the well annulus, the tester valve is opened to lower the pressure in the well bore adjacent the formation to be tested such that formation fluids may flow from the formation into the lower end of the tubular string and from there to the surface.

Pressure sensors are typically included in the testing string such that the tester valve may be opened and closed and pressure recordings made to evaluate the production potential of the formation being tested.

Two types packers may be used. The first type is a packer which may be incorporated in a testing string and expanded by manipulation of the testing string to effect a seal between the walls of the well bore and the tubular pipe testing string. A second type is a wireline set production packer which is lowered and attached to the walls of the well bore at the desired location. The testing string having a seal assembly at its lower end is subsequently lowered into the well bore until the seal assembly is seated in the production type packer to effect the seal necessary to isolate the formation.

It will be understood that if a production type packer is used, fluid trapped in the well bore below the production packer will be compressed as the testing string is further lowered into place after the seal assembly has effected its seal in the production packer. This fluid trapped in the well bore below the packer must be displaced back into the formation as the seal assembly is further lowered into the packer. The displacement of drilling fluid into the formation is undesirable in that it may seal or otherwise damage the pore spaces in the formation through which oil and gas must be produced. Also, if an annulus pressure operated well tester valve having a pressure operated isolation valve such as that disclosed in U.S. Pat. No. 3,964,544 or U.S. Pat. No. 3,976,136 is used, the compression of fluid in the central bore of the testing string below the tester valve will increase the operating pressure of the tester valve to an undesirably high level.

The use of the present invention prevents excessive pressure from the trapped fluid from developing which might otherwise damage the packer, the pressure recorder, the tester valve, or other tools in the testing string. Also, this trapped fluid might support the testing string thereby preventing its downward movement to completely seat in a tubing hanger. When a tester valve in the testing string is subsequently opened, the trapped fluid will be released allowing the testing string to fall which may, in turn, damage the tubing of the string or the hanger.

SUMMARY OF THE INVENTION

In the present invention, a check valve means is provided below the tester valve and above the seal assembly at the lower end of the testing string, and is designed to allow compressed fluid in the central bore of the testing string below the closed tester valve to escape to the well annulus above the packer. When the well annulus pressure is increased to operate tester valves such as those disclosed in the aforementioned U.S. Pat. Nos. 3,964,544 and 3,976,136, the check valve prevents pressure from increasing in the testing string central bore, and a sleeve is activated to block the check valve means in a closed position. The sleeve is then locked in the closed position such that treating operations of the formation as disclosed in U.S. Pat. No. 3,976,136 may be conducted, such as displacing chemicals into the formation without allowing them to escape into the well annulus through the check valve.

The present invention makes the use of annulus pressure operated testing apparatus in combination with a production type packer more efficient since the pressure level necessary to operate the testing tools is not unduly raised and the operation of the tools is not otherwise affected.

It is common practice when a production packer is used in testing to lower the testing string into the well bore until the packer is "tagged" by setting a portion of the testing string weight down on the packer. The resultant change in weight indication at the surface as a result of tagging the packer is used to determine the exact location of the packer.

The testing string is then withdrawn an amount from the well bore so that a hanging device may be installed in the string. This hanging device is then used to support the weight of the testing string such that the seal assembly is engaged with the packer without an undue amount of weight being supported by the packer.

FIGS. *2a–2d* joined along section lines a—a, b—b and c—c provide a "vertically-sectioned" elevational view of a preferred embodiment of the present invention showing a check valve means having a radially extensible rubber sleeve, pressure balanced sleeve means for closing the check valve means when well annulus pressure is increased, a shear mechanism means for controlling the movement of the pressure balanced sleeve means and a locking means for locking the pressure balanced sleeve means in a closed position.

DESCRIPTION OF THE PREFERRED EMBODIMENT

Figure 1:
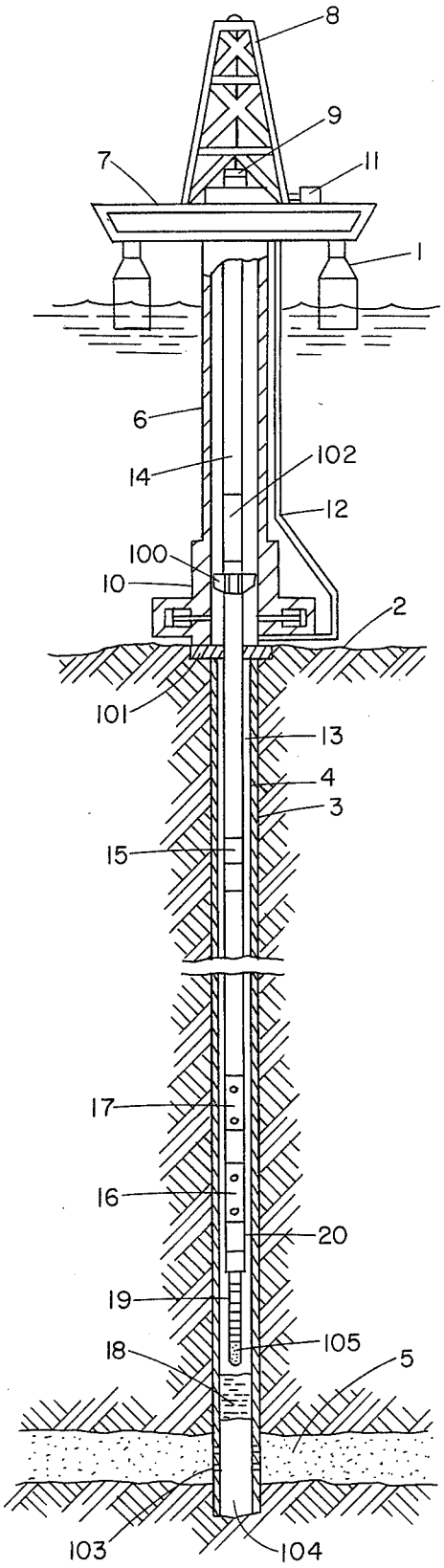
FIG. 1 provides a schematic "vertically-sectioned" view of a representative offshore installation which may be employed for formation testing purposes and illustrates a formation testing "string" or tool assembly as it is being lowered into a submerged well bore to the point just before the seal assembly enters a production type packer, and with the testing string extending upwardly to a floating operating and testing station.

Referring to FIG. 1, the present invention is shown in a testing string for use in an offshore oil or gas well.

In FIG. 1, a floating work station is centered over a submerged oil or gas well located in the sea floor 2 and having a bore hole 3 which extends from the sea floor 2 to a submerged formation 5 to be tested. The bore hole 3 is typically lined by a steel liner 4 cemented into place. A subsea conduit 6 extends from the deck 7 of the floating work station 1 to a well head installation 10. The floating work station 1 has a derrick 8 and a hoisting apparatus 9 for raising and lowering tools to drill, test and complete the oil or gas well.

A testing string 14 is being lowered into place in the bore hole 3 of the oil or gas well. The testing string 14 includes such tools as a slip joint 15 to compensate for the wave action of the floating work station 1 as the testing string is being lowered into place, a tester valve 16 and a circulation valve 17.

The slip joint 15 may be similar to that described in U.S. Pat. No. 3,354,950 issued to Hyde on Nov. 28, 1967. The tester valve 16 may be one of the annulus pressure responsive types and is preferably one of the full opening types such as described in U.S. Pat. No. 3,856,085 issued to Holden et al on Dec. 24, 1974, or that as described in U.S. Pat. No. 3,976,136 issued to Farley et al on Aug. 24, 1976, or that described in U.S. Pat. No. 3,964,544 issued on Farley et al on June 22, 1976.

The circulation valve 17 is preferably of the annulus pressure responsive type and may be that described in U.S. Pat. No. 3,850,250 to Holden et al issued Nov. 26, 1974, or may be a combination circulation valve and sample entrapping mechanism similar to those disclosed in U.S. Pat. No. 4,063,593 issued to Jessup on Dec. 20, 1977, or U.S. Pat. No. 4,064,937 issued to Barrington on Dec. 27, 1977. The circulation valve 17 may also be the reclosable type as disclosed in U.S. Pat. No. 4,113,012 issued to Evans et al on Sept. 12, 1978.

As described in the aforementioned U.S. Patents, both the tester valve 16 and the circulation valve 17 are operated by annulus pressure exerted by a pump 11 on the deck of the floating work station 1. Pressure changes are transmitted by a conductor pipe 12 to the well annulus 13 between the casing 4 and the testing string 14. Well annulus pressure is isolated from the formation 5 to be tested by a packer 18 set in the well casing just above the formation 5. The check valve assembly 20 of the present invention is located in the testing string 14 below the tester valve 16. This check valve assembly 20 is most advantageously used with a permanent production type packer 18 which, for instance, may be the Baker Model D packer, the Otis type W packer or the Halliburton EZ DRILL ® SV packer. Such packers are well known in the oil well testing art.

The testing string 14 includes a tubing seal assembly 19 at the lower end of the testing string 14 which stabs through a passageway through the production packer 18 for forming a a seal isolating the well annulus 13 above the packer 18 from an interior bore portion 104 of the well immediately adjacent the formation 5 and below the packer 18.

A perforated tail piece 105 or other production tube is located at the bottom end of the seal assembly to allow formation fluids to flow from the formation 5 into the flow passage of the testing string 14. Formation fluid is admitted into well bore portion 104 through perforations 103 provided in the casing 4 adjacent formation 5.

A formation test controlling the flow of fluid from the formation 5 through the flow channel in the testing string 14 by applying and releasing annulus pressure to the well annulus 13 by the pump 11 to operate the tester valve 16 and the circulation valve assembly 17 and measuring the pressure build-up curves with appropriate pressure sensors in the testing string 14 as fully described in the aforementioned patents.

The testing string 14 is lowered into the oil and gas well bore 3 by the hoisting means 9 until a fluted hanger 100 is in supporting contact with a supporting pad means 101 at the sea floor 2. Above the fluted hanger 100 is a subsea test tree 102 which may be, for instance, the pressure operated subsea test tree disclosed in U.S. Pat. No. 4,116,272 issued to Barrington on Sept. 26, 1978, or may be the hydraulically operated subsea test tree available from Otis Engineering Corporation of Dallas, Tex.

One common way of locating the fluted hanger 100 at the proper location in the testing string 14 is to lower the testing string 14 without the hanger into the oil or gas well bore 3 until the seal assembly 19 is fully inserted into the packer 18 and the bottom end of the testing string 14 rests on top of the packer 18. This event is indicated at the surface by a reduction in the weight of the testing string 14 as more of the weight is supported by the packer 18. The testing string 14 is then marked and subsequently removed from the well bore sufficiently until the fluted hanger may be installed in the testing string 14 at the proper distance below the mark such that when the testing string 14 is relowered into the well bore 3, the fluted hanger 100 rests on the pad means 101 and the sealing means 19 will be inserted into the packer 18 but without the weight of the testing string 14 being supported by the packer 18.

It can be seen that when the sealing means 19 is inserted into the packer 18, fluid will be trapped in central bore portion 104. This trapped fluid must be displaced back into the formation as the sealing means 19 is inserted further into the interior bore 104. It will also be understood that movement of the sealing means 19 and the perforated tail piece 105 into the interior bore 104 will cause the pressure in the interior bore portion 104 to rise, thus increasing the pressure necessary to operate a pressure operated isolation valve used in tester 16, if a tester valve such as that disclosed in U.S. Pat. No. 3,964,544 is used.

The check valve assembly 20 of the present invention is installed below the tester valve 16 for allowing trapped formation fluid in the interior bore portion 104 to move into the well annulus 13 as the sealing assembly 19 is pushed further into interior bore portion 104. This prevents the excessive build-up of pressure in the interior of the testing string 14 below the tester valve 16 and also prevents drilling mud in the interior bore portion 104 from being pushed into the formation 5 as the testing string 14 is lowered during its last increment of travel into place.

Referring to FIGS. 2*a* through 2*d*, the preferred embodiment of the present invention, check valve assembly 20, is shown. The check valve assembly 20 comprises an adapter means 22 having check valve seal means 24 thereon and sealing mandrel means 26 therein, shear case means 28 having shear means 30 and locking dog means 32 therein, pressure housing means 34 having shear mandrel means 36 therein, and nipple means 38.

Figure 2A:
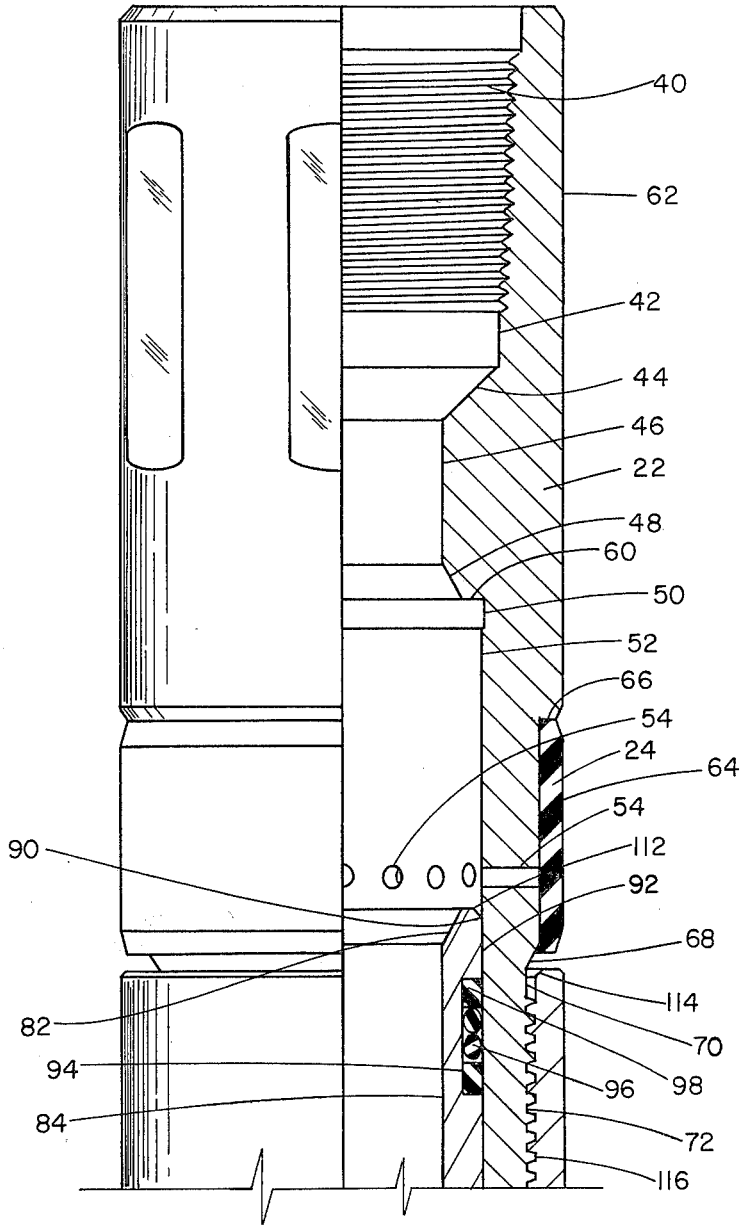
Figure 2B:
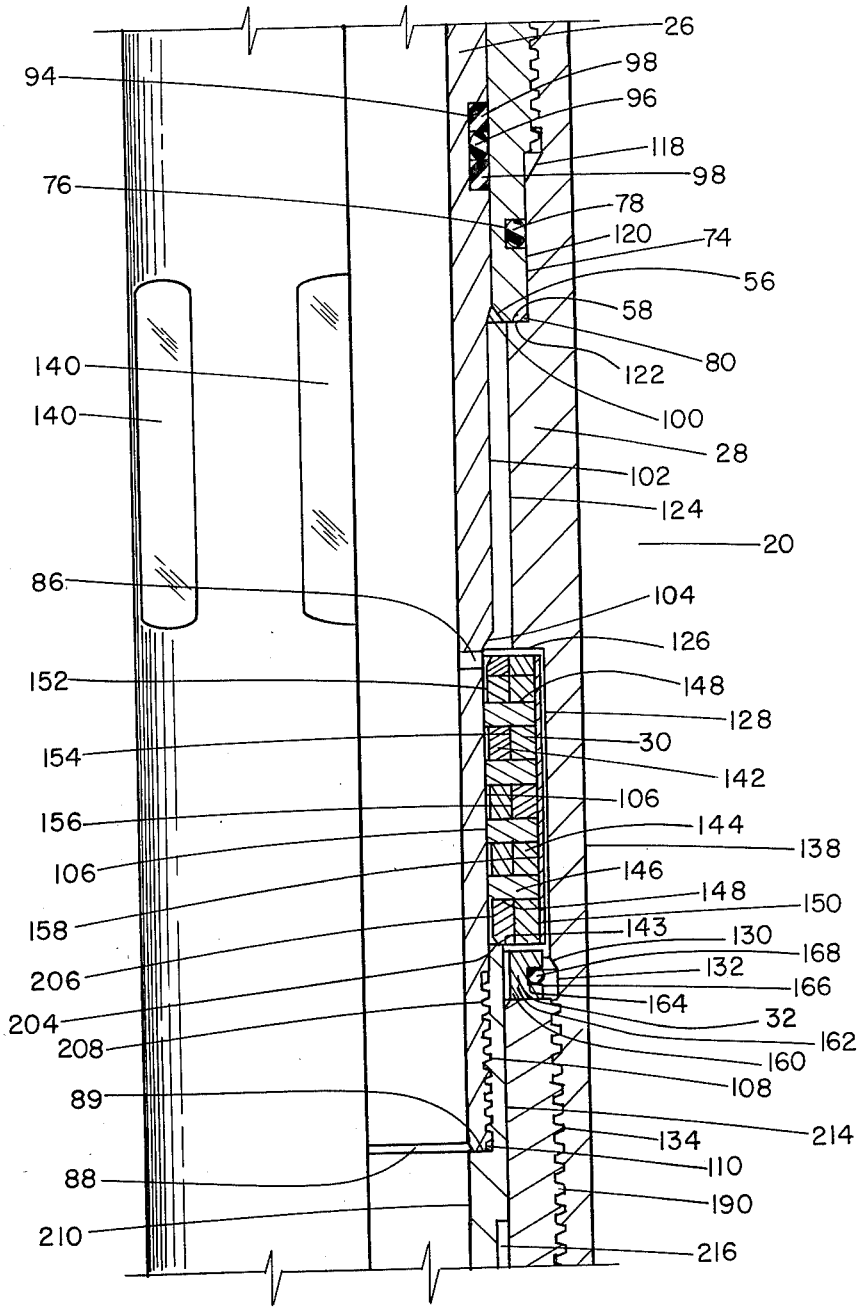
Figure 2C:
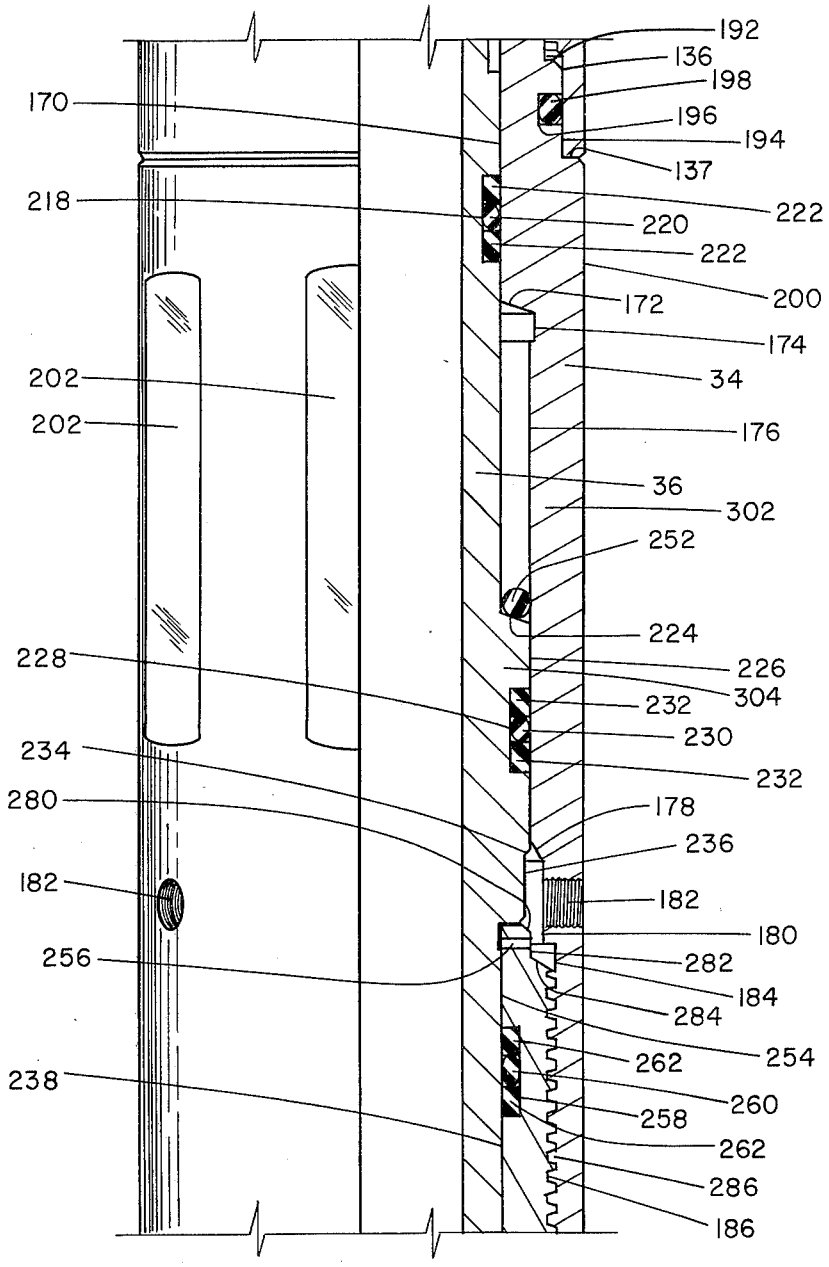
Figure 2D:
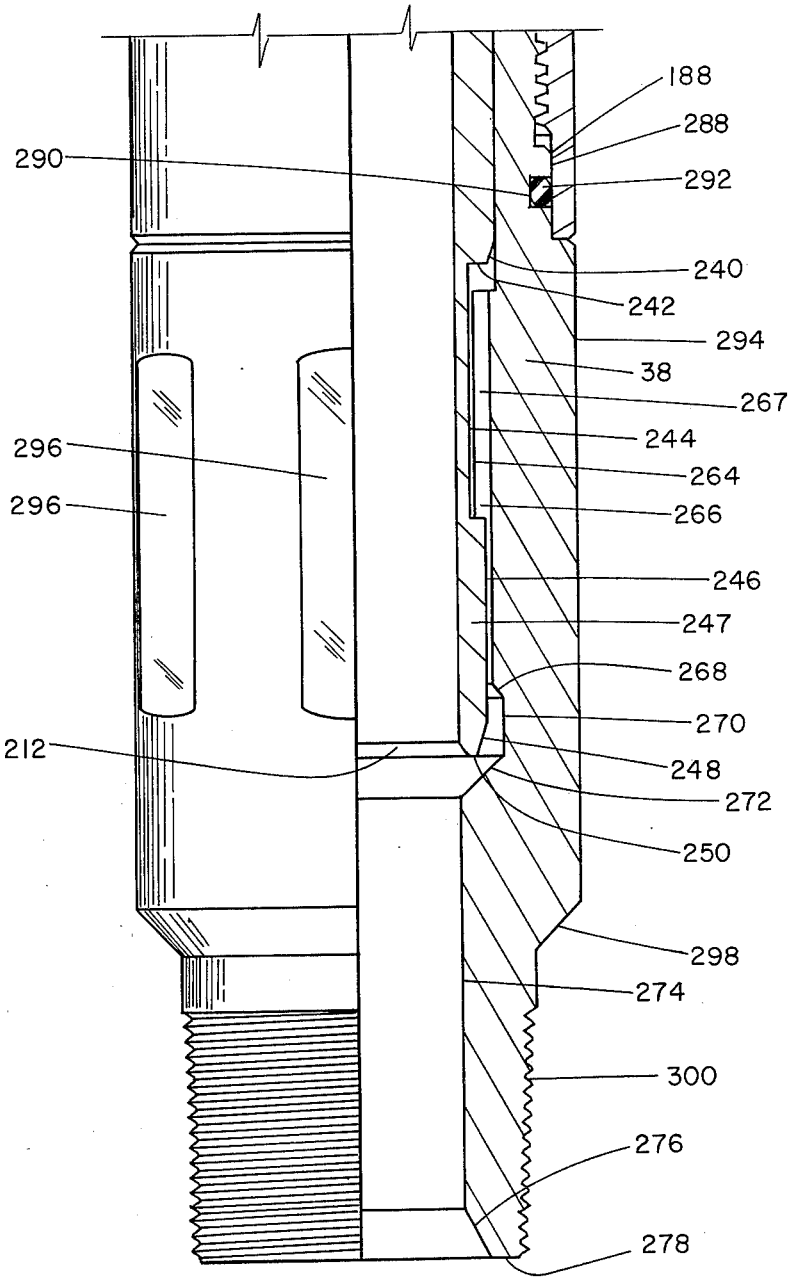

Referring to FIGS. 2*a* and 2*b*, the adapter means 22 comprises an elongated annular member having an irregular bore therethrough and an irregular exterior surface thereon.

The irregular bore of the adapter means 22 comprises on one end thereof a threaded portion 40, first cylindrical bore 42, first annular chamfered surface 44, second cylindrical bore 46 which has a smaller diameter than the first cylindrical bore 42, second annular chamfered surface 48, third cylindrical bore 50 which has a diameter greater than that of second cylindrical bore 46, fourth cylindrical bore 52 which has a diameter smaller than that of the third cylindrical bore 50 and has a plurality of apertures 54 extending through the well of the adapter means 22, thereby allowing communication between the fourth cylindrical bore 52 and the exterior of the adapter means 22, and third annular chamfered surface 56 on the other end thereof which terminates in the end face 58 of the adapter means 22.

The threaded portion 40 of the adapter means 22 is utilized to join the check valve assembly 20 to the testing string 14, shown in FIG. 1, for instance, under the tester valve 16 which may be of the type illustrated and discussed in U.S. Pat. Nos. 3,964,544 and 3,976,136.

The irregular exterior surface of the adapter means 22 comprises on one end first cylindrical surface 62, second cylindrical surface 64 having a diameter smaller than that of the first cylindrical surface 62 and forming annular shoulder 66 with respect thereto, first annular chamfered surface 68, third cylindrical surface 70, threaded portion 72, fourth cylindrical surface 74 having an annular cavity 76 therein which contains an elastomeric seal means 78 therein, and second annular chamfered surface 80 on the other end thereof.

The check valve seal means 24 comprises an elastomeric member located on the second cylindrical surface 64 of the exterior surface of the adapter means 22 having one end abutting shoulder 66 and overlying the plurality of apertures 54 extending from the cylindrical bore 50. The check valve seal means 24 is provided to allow fluid passage from the bore of the adapter means 22 through the plurality of apertures 54 to the wall annulus exterior of the check valve assembly 20, while preventing fluid flow from the well annulus exterior of the check valve assembly 20 into the bore of the adapter means 22 through apertures 54. The check valve seal means 24 may be constructed of any suitable elastomeric material.

The seal means 78 located in annular cavity 76 in the adapter means 22 comprises an annular elastomeric seal means. The seal means 78 may be any suitable type elastomeric seal means, such as an O-ring type elastomeric seal means.

Received within the fourth cylindrical bore 52 of the adapter means 22 is sealing mandrel means 26. The sealing mandrel means 26 comprises an elongated annular member having a bore therethrough and an irregular exterior surface.

The bore of the sealing mandrel means 26 comprises, on one end, annular chamfered surface 82, cylindrical bore 84 having a plurality of apertures 86 therein communicating the bore 84 with the exterior of the sealing mandrel means 26 and, on the other end, annular chamfered surface 88 terminating in end surface 89.

The irregular exterior surface of the sealing mandrel means 26 comprises, on one end, annular chamfered surface 90, first cylindrical surface 92 having a plurality of annular cavities 94 therein, each cavity 94 containing primary seal means 96 and backup seal means 98 therein, second annular chamfered surface 100, second cylindrical surface 102 having a diameter smaller than that of the first cylindrical surface 92, third annular chamfered surface 104, third cylindrical surface 106 having a diameter smaller than that of the second cylindrical surface 102, threaded portion 108 and, on the other end, annular chamfered surface 110 terminating in end surface 89.

The primary seal means 96 may be any suitable type elastomeric seal means, such as an O-ring type elastomeric seal means. The backup seal means 98 preferably comprises a seal means having a rectangular cross-sectional area, such as an annular member of polytetrafluoroethylene material having a rectangular cross section. The backup seal means 98 are located on either side of the primary seal means 96 in the annular recesses 94.

It should be understood that the first cylindrical surface 92 of the sealing mandrel means 26 has substantially the same diameter as the fourth cylindrical bore 52 of the adapter means 22. When the sealing mandrel means 26 is installed in the adapter means 22, the primary seal means 96 and backup seal means 98 sealingly engage the fourth cylindrical bore 52 of the adapter means 22 while allowing relative movement between the adapter means 22 and sealing mandrel means 26.

Referring generally to FIG. 2*b*, the shear case means 28 comprises an elongated annular member having an irregular bore therethrough and generally cylindrical exterior surface.

The irregular bore of the shear case means 28 comprises, on one end, first annular chamfered surface 114, first threaded portion 116, second annular chamfered surface 118, first cylindrical bore 120, second cylindrical bore 124 having a diameter smaller than the diameter of the first cylindrical bore 120 but larger than the diameter of the first cylindrical bore 92 of the sealing mandrel means 26, third cylindrical bore 128 which has a diameter larger than the diameter of the second cylindrical bore 124, third annular chamfered surface 130, fourth cylindrical bore 132 having a diameter greater than that of the diameter of the third cylindrical bore 128, second threaded portion 134 and, on the other end, fifth cylindrical bore 136 having a diameter larger than that of the fourth cylindrical portion 132 terminating in end surface 137.

The exterior surface of the shear case means 28 comprises cylindrical surface 138 having a plurality of wrenching flat means 140 thereon.

It should be understood that the first threaded portion 116 has a diameter and thread means thereon substantially equal to the diameter and thread means of threaded portion 72 of the adapter means 22 to allow the shear case means 28 to be threadedly engaged therewith.

Contained within shear case means 28 are shear means 30. The shear means 30 comprise an assembly of first shear sleeve means 142, second shear sleeve means 144, shear pin means 146 and cover means 150.

The first shear sleeve means 142 comprises an annular member having an internal surface 152 having a diameter slightly larger than the diameter of the third cylindrical surface 106 of the sealing mandrel means 26 but smaller than the diameter of the second cylindrical surface 102 thereof, an external surface 154 having a diameter slightly smaller than the diameter of second cylindrical bore 124 of the shear case means 28 and a plurality of apertures 148 extending through the wall thereof from surface 152 to surface 154.

The second shear sleeve means 144 comprises an annular member having an internal surface 156 having a diameter slightly larger than the diameter of surface 154 of the first sleeve means 142 but smaller than the diameter of second cylindrical bore 124 of the shear case means 28, an external surface 158 having a diameter smaller than the diameter of the third cylindrical bore 128 of the shear case means 28 and a plurality of apertures 148 extending through the wall thereof from surface 152 to surface 154. The plurality of apertures 148 in the second shear sleeve means 144 are aligned with the apertures 148 in the first sleeve means 142 and have the same diameter.

The shear pin means 146 comprise a plurality of shear pins which are retained in apertures 148 in the first 142 and second 144 shear sleeve means. The shear pin means may be of any suitable material, although brass is preferred.

To retain the shear pin means 146 in the apertures 148 in the first 142 and second 144 shear sleeve means, a cover means 150 is provided. The cover means 150 comprises an annular tubular member having an internal diameter which allows it to be fitted over the exterior surface 158 of the second sleeve means 144 and having an external diameter which allows the sleeve to be received within the third cylindrical bore 128 of the shear case means 28.

When assembled, the shear means 30 is retained within the cavity formed by the third cylindrical bore 128 of the shear case means 28 and the second cylindrical surface 106 of the sealing mandrel means 26 being prevented from movement in one direction by the second sleeve means 144 abutting end surface 126 of the bore of shear case means 28.

Also contained within shear case means 28 are locking dog means 32. The locking dog means 32 comprise a plurality of arcuate shaped annular members 162, each arcuate shaped annular member 162 having a recess 164 in the outer surface 166 thereof receiving an elastomeric member 168 therein. The locking dog means 32 are retained or located in the shear case means 28 between fourth cylindrical bore 132 and first cylindrical surface 214 of the shear mandrel means 36 and between end surface 204 of the shear means 30 and end surface 126 of the pressure housing means 34. The elastomeric member 168 may be any suitable type elastomeric member which has sufficient strength and resiliency to retain the arcuate shaped annular members 162 in an assembled relationship in the shear case means 28, such as an O-ring type elastomeric member.

Referring to FIGS. *2b, 2c* and *2d,* connected to the second threaded portion 134 of the shear case means 28 is pressure housing means 34. The pressure housing means 34 comprises an elongated annular member having an irregular bore therethrough an irregular exterior surface thereon.

The irregular bore of the pressure housing means 34 comprises a first cylindrical bore 170 having substantially the same diameter as the fourth cylindrical bore 52 of the adapter means 22, first annular chamfered surface 172, second cylindrical bore 174 having a diameter greater than that of the first cylindrical bore 170, third cylindrical bore 176 having a diameter smaller than that of the second cylindrical bore 174, second annular chamfered surface 178, fourth cylindrical bore 180 having a diameter greater than that of third cylindrical bore 176 and having a plurality of apertures 182 extending through the wall of the pressure housing means 34 therein allowing communication between the interior or irregular bore of the pressure housing means 34 and the exterior thereof, fifth cylindrical bore 184 having a diameter greater than that of the fourth cylindrical bore 180, threaded portion 186 and sixth cylindrical bore 188 having a diameter substantially the same as the fifth cylindrical bore 184.

The irregular shaped exterior surface of the pressure housing means 34 comprises threaded portion 190 having substantially the same diameter as second threaded portion 134 of the shear case means 28 to threadedly engage therewith, annular chamfered surface 192, first cylindrical surface 194 having an annular cavity or recess 196 therein containing an elastomeric seal means 198 and second cylindrical surface 200 having substantially the same diameter as cylindrical surface 138 of the shear case means 28 and having a plurality of wrenching flat means 202 thereon.

Slideably disposed within the pressure housing means 34 is shear mandrel means 36.

The shear mandrel means 36 comprises an irregular shaped bore therethrough and an irregular shaped exterior surface thereon.

The irregular shaped bore of the shear mandrel means 36 comprises first cylindrical bore 206 having a diameter slightly greater than that of the diameter of the third cylindrical surface 106 of the sealing mandrel means 26, threaded portion 208 having substantially the same diameter as threaded portion 108 of the sealing mandrel means 26 being threadedly engaged therewith, second cylindrical bore 210 having a diameter substantially equal to the diameter of the cylindrical bore 84 of the sealing mandrel means 26, and annular chamfered surface 212 terminating in end surface 250.

The irregular exterior surface of the shear mandrel means 36 comprises first cylindrical surface 214 having substantially the same diameter as the first cylindrical surface 92 of the sealing mandrel means 26, having locking dog annular cavity means 216 therein and having annular cavity 218 having primary seal means 220 and backup seal means 222 therein, first annular chamfered surface 224, second cylindrical surface 226 having a diameter substantially equal to the diameter of the third cylindrical bore 176 of the pressure housing means 34 and having annular cavity 228 having primary seal means 230 and backup seal means 232 therein, second annular chamfered surface 234, third cylindrical surface 236 having a diameter slightly smaller than the diameter of the second cylindrical surface 226, fourth cylindrical surface 238 having a diameter substantially equal to the diameter of the fourth cylindrical bore 52 of the adapter means 22, third annular chamfered surface 240, fifth cylindrical surface 244 having a diameter smaller than that of the diameter of the fourth cylindrical surface 238, sixth cylindrical surface 246 having a diameter greater than that of the diameter of the fifth cylindrical surface 244 but less than the diameter of the fourth cylindrical surface 238 and fourth annular chamfered surface 248 terminating in end surface 250 of the shear mandrel means 36. The sixth cylindrical surface 246 contains a plurality of longitudinal recesses (not shown) therein which extend from end surface 250 of the shear mandrel means 36 to the fifth cylindrical portion 244 thereof, thereby forming a plurality of lug means 247.

It should be noted that the axial length or width of the locking dog annular cavity means 216 is greater than the axial length or width of the locking dog means 32 so that the locking dog means 32 may be received therein.

The primary seal means 218 and 228 and the backup seal means 222 and 232 are similar in construction to the primary seal means 96 and backup seal means 98 described hereinbefore.

Installed between the shear mandrel means 36 and the pressure housing means 34 in slidable sealing relationship therewith and abuttingly engaging the first chamfered surface 224 of the shear mandrel means 36 is elastomeric seal means 252. The elastomeric seal means 252 may be any suitable type elastomeric seal means, such as an O-ring type elastomeric seal means.

Referring generally to FIG. *2d,* secured to threaded portion 186 of the pressure housing means 34 is nipple means 38. The nipple means 38 comprises an elongated annular member with an irregular bore therethrough and irregular exterior surface thereon.

The irregular bore of the nipple means 38 comprises first cylindrical bore 254 having substantially the same diameter as the diameter of the fourth cylindrical bore 52 of the adapter means 22, having a plurality of apertures 256 extending through the wall of the nipple means 38 to allow communication between the bore of the nipple means 38 and the exterior surface thereof, and having annular cavity 258 having primary seal means 260 and backup seal means 262 therein, second cylindrical bore 264 having a diameter slightly greater than the diameter of the fifth cylindrical surface 244 of the shear mandrel means 36 and having a plurality of longitudinal annular recesses 266 therein having a depth sufficient to receive lug means 246 of the shear mandrel means 36 slidingly therein, thereby forming a plurality of lug means 267 on the nipple means 38, first annular chamfered surface 268, third cylindrical bore 270 having a diameter greater than the diameter of the sixth cylindrical surface 246 of the shear mandrel means 36, second annular chamfered surface 272, fourth cylindrical bore 274 having a diameter substantially equal to the diameter of second cylindrical bore 210 of the shear mandrel means 36 and third annular chamfered surface 276 terminating in end surface 278 of the nipple means 38.

The primary 260 and backup 262 seal means are similar in construction to the primary 96 and backup 98 seal means of the sealing mandrel means 26 described hereinbefore.

The exterior surface of the nipple means 38 comprises first annular chamfered surface 280, first cylindrical surface 282 having a diameter smaller than the diameter of fourth cylindrical bore 180 of the pressure housing means 34 and having a plurality of apertures 256 therein, second annular chamfered surface 284, first threaded portion 286 having a diameter substantially the same as the diameter of threaded portion 186 of the pressure housing means 34 thereby threadedly engaging therewith, second cylindrical surface 288 having a diameter substantially the same as the diameter of the sixth cylindrical bore 188 of the pressure housing means 34 and having annular cavity means 290 containing elastomeric seal means 292 therein sealingly engaging the sixth cylindrical bore 188, third cylindrical surface 294 having a diameter substantially equal to the second cylindrical surface 200 of the pressure housing means 34 and having a plurality of wrenching flat means 296 thereon, third annular chamfered surface 298, and second threaded portion 300 for connection of other tools or pipe terminating in end surface 278.

When the check valve assembly 20, shown in FIGS. *2a* through *2d,* is assembled, the adapter means 22 having check valve seal means 24 thereon, the shear case means 28, the pressure housing means 34 and the nipple means 38 are secured together to form the outer housing 302 of the check valve assembly 20. Disposed within the assembled check valve assembly 20 in slidable sealing engagement with various bores of the adapter means 22, the shear case means 28, the pressure housing means 34 and nipple means 38 are the sealing mandrel means 26 and shear mandrel means 36 which are secured together to form a sliding mandrel means 304 within the outer housing of the check valve assembly 20.

It should be noted that the sliding mandrel means formed by the sealing mandrel means 26 and shear mandrel means 36 is pressure balanced within the outer housing of the check valve assembly 20 by virtue of the first cylindrical surface 92 of the sealing mandrel means 26, the first cylindrical surface 214 of shear mandrel means 36 and the fourth cylindrical surface 238 of shear mandrel means 36 having substantially the same diameter and respectively sealingly engaging the fourth cylindrical bore 52 of the adapter means 22, the first cylindrical bore 170 of the pressure housing means 34, and first cylindrical bore 254 of the nipple means 38, which bores all have substantially the same diameter. By having the sliding mandrel means 304 pressure balanced, any internal fluid pressure fluctuations will not cause the sliding mandrel means to be urged in either direction within the outer housing 302 of the check valve assembly 20.

It will be understood that when the check valve assembly 20 is lowered into the well bore 3 as part of the testing string 14, the pressure in the well annulus 13 will be equal to the pressure in the interior bore of the check valve assembly 20. Thus, while the check valve assembly 20 is being lowered into place, there will be no transfer of fluid through the apertures 54. When the testing string 14 is lowered sufficiently such that the seal assembly 19 is sealingly inserted into the packer 18, the fluid pressure in the bore of the check valve means 20 will begin to increase and ultimately be at a level higher than the fluid pressure in the well annulus 12 as the testing string 14 is lowered further into the hole and as well fluid trapped in the well bore portion 104 is compressed by the seal assembly 19 moving into portion 104. The higher fluid pressure in the bore of the check valve assembly 20 will cause the check valve seal means 24 to expand radially outwardly to allow fluid to flow through apertures 54 and into the well annulus 13. When sufficient fluid is expelled from the bore of the check valve assembly 20, the fluid pressure in the bore of the check valve assembly 20 will again equal the well annulus pressure, and the check valve seal means 24 will return to its original position sealingly engaging the apertures 54 to prevent fluid flow therethrough.

In this manner, well fluid will be removed from the well bore portion 104 or packer 18 until the testing string 14 is fully seated into place. When the testing string 14 has been lowered sufficiently, a portion of the testing string weight is supported by the packer 18 and will be registered at the surface by a change in the testing string weight sensing apparatus. The testing string 14 will then be marked at the surface 7 of the work station 1 and the testing string 14 will be removed from the well bore 4 a sufficient distance such that the fluted hanger 100 may be installed at the proper location in the testing string 14. The testing string 14 is then once again lowered into the well bore 4 until the fluted hanger 100 comes to rest on the supporting pad means 101. The fluted hanger 100 is installed in the testing string 14 such that the weight of the testing string 14 below the hanger 100 will be supported by the hanger 100 with the sealing assembly 19 inserted into the packer 18.

When this condition prevails, the annulus pressure operated tester valve 16 may be operated in the usual manner. When the well annulus fluid pressure level is raised or increased to operate the tester valve 16, the sliding mandrel means formed by the sealing mandrel means 26 and shear mandrel means 36 of the check valve assembly 20 will move upwardly in the outer housing of the check valve assembly 20 upon reaching a predetermined fluid pressure level and block or cover the apertures 54 to prevent any subsequent fluid flow from the bore of the check valve assembly 20 to the exterior thereof through the apertures 54.

The sliding mandrel means formed by the sealing mandrel means 26 and shear mandrel means 36 of the check valve assembly 20 is caused to move upwardly when the fluid pressure in the well annulus reaches a predetermined level by fluid flowing through apertures 182 in the pressure housing means 34 into the fourth cylindrical bore 180 thereof and acting across the annular area formed by the second annular chamfered surface 234, third cylindrical surface 236, annular shoulder 237 and fourth cylindrical surface 238 of the shear mandrel means 36. Since the annular area formed by the surfaces 234, 236 and 238 and annular shoulder 237 is sealed from fluid communication with the interior of the check valve assembly 20 by primary and backup seal means 230, 260, 232 and 262 respectively, and is larger than the annular area formed by the sliding mandrel means 304 between first cylindrical surface 214 and cylindrical bore 84 thereof and since the annulus fluid pressure is greater than the fluid pressure in the bore of the check valve assembly 20, upon reaching a predetermined fluid pressure level in the annulus of the well bore, the sliding mandrel means 304 will move upwardly in the check valve assembly 20.

To prevent the sliding mandrel means 30 from moving upwardly in the check valve assembly 20 whenever the fluid pressure in the annulus of the well bore exceeds the fluid pressure in the bore of the assembly 20, the end surface 204 of the shear mandrel means 36 engages end 143 of the first shear means 142 of the shear means 30.

By varying the number of shear pin means 146 retaining the first shear sleeve means 142 to the second shear sleeve means 144 the amount of force necessary to shear the shear pin means 146 to allow the sliding mandrel means 304 to move upwardly in the check valve assembly 20 and the amount of annulus fluid pressure level necessary to create the amount of force may be determined. When sufficient force has been applied to the sliding mandrel means 304, the shear pin means 146 are sheared thereby allowing the sliding mandrel means 304 to move within the check valve assembly 20 while also moving the first shear sleeve means 142 and those portions of the shear pin means 146 which have been sheared and retained within the first sleeve means 142 therewith until end surface 112 of the sealing mandrel means 26 abuts surface 60 of adapter means 22. To retain the sliding mandrel means 304 in this position, locking dog means 32 engage locking dog cavity means 216 on the shear mandrel means 36 to prevent further movement thereof. The locking dog means 32 are resiliently biased into the locking dog cavity means 216 by the elastomeric member 168.

It should be noted that when the sliding mandrel means 304 moves upwardly in the outer housing 302 of the check valve assembly 20, the elastomeric seal means 252 which moves concurrently with the sliding mandrel means 304 cushions the impact of the sliding mandrel means 304 when the first annular chamfered surface 224 of the shear mandrel means 36 abuts first annular chamfered surface 172 of the pressure housing means 34.

It should be recognized from the foregoing discussion that the check valve assembly of the present invention offers several advantages over the other types of bypass valves.

The check valve assembly of the invention does not require the use of metering fluids and metering fluid systems, nor the care and cleanliness associated with the maintenance of a metering fluid system.

The check valve assembly of the present invention has a pressure balanced sliding mandrel means therein which is not affected by internal fluid pressure fluctuations in the check valve assembly.

The check valve assembly of the present invention uses a simple, reliable, easily controlled shear means.

The check valve assembly of the present invention has a simple, reliable locking dog means to retain the sliding mandrel means in one position in the outer housing of the valve assembly.

The check valve assembly of the present invention has a simple, reliable check valve seal means to control the flow of fluid from the interior of the check valve assembly to the exterior thereof.

The check valve assembly of the present invention is simple to manufacture, assemble and use.

It will be evident to those of ordinary skill in the art that the disclosed embodiment of the present invention and all equivalent embodiments may be used in any situation where a check valve assembly which is responsive to variations in annulus fluid pressure is desired.

Having thus described my invention, what is claimed is:

1. A check valve assembly comprising:

outer annular housing means having first and second aperture means through the wall thereof and having an irregular bore therethrough;

sliding annular mandrel means having an irregular exterior surface having annular shoulder means thereon disposed between the first and second aperture means through said outer annular housing means, said sliding annular mandrel means being slidably disposed in a first position within the bore of said outer annular housing means in sealing engagement therewith having the annular shoulder means of said sliding annular mandrel means communicating with the first aperture means of said outer annular housing means while the bore of said sliding annular mandrel means communicates with the second aperture means of said outer annular housing means;

check valve seal means retained on the exterior of said outer annular housing means blocking the second aperture means of said outer annular housing means, said check valve seal means allowing communication from the bore of said outer annular housing means to the exterior thereof but preventing communication from the exterior of said outer annular housing means to the bore thereof; and shear means disposed within said outer annular housing means having a first portion thereof engaging a portion of the irregular exterior surface of said sliding annular mandrel means and having a second portion thereof engaging a portion of the irregular bore through said outer annular housing means, said shear means initially preventing movement of said sliding annular mandrel means with respect to said outer annular housing means when said sliding annular mandrel means is disposed within said outer annular housing means in a first position therein until a predetermined amount of force is applied to said annular sliding mandrel means.

2. The check valve assembly of claim 1 further comprising:

locking dog means disposed within said outer annular housing means, said locking dog means allowing movement of said sliding annular mandrel means from the first position within said outer annular housing means.

3. The check valve assembly of claim 2 further comprising:

locking dog cavity means disposed on said sliding annular mandrel means, said locking dog cavity means being disposed on said sliding annular mandrel means to allow movement of said sliding annular mandrel means from the first position within said annular housing means to a second position within said annular mandrel means, whereby said locking dog means engage said locking dog cavity means to prevent movement of said sliding annular mandrel means from the second position within said sliding annular housing means.

4. The check valve assembly of claim 3 further comprising:

lug means on the exterior surface of one end of said sliding annular mandrel means; and longitudinal cavity means located in a portion of the irregular bore of said outer annular housing means slidably receiving said lug means of said sliding annular mandrel means therein.

5. The check valve assembly of claim 1 wherein said outer annular housing means comprises:

annular adapter means having the second aperture means through the wall thereof and an irregular bore therethrough;

annular shear case means having one end thereof secured to one end of the annular adapter means, the annular shear case means having an irregular bore therethrough;

annular pressure housing means having one end thereof secured to the other end of the annular shear case means, having the first aperture means through the wall thereof and having an irregular bore therethrough, the annular pressure housing means receiving the annular shoulder means of said sliding annular mandrel means therein; and annular nipple means having one end secured to the other end of the annular pressure housing means, having an irregular bore therethrough and having longitudinal cavity means located in a portion of the irregular bore.

6. The check valve assembly of claim 5 wherein said sliding mandrel means comprises:

annular sealing mandrel means having an irregular exterior surface thereon; and shear mandrel means secured to one end of the annular sealing mandrel means, the shear mandrel means having an irregular exterior surface thereon, having shear means abutment means on the end of the annular shear mandrel means secured to the annular sealing mandrel means, having annular shoulder means on the irregular exterior surface thereof and having lug means on the other end of the shear mandrel means, the lug means slidably engaging the longitudinal cavity means located in a portion of the irregular bore of the annular nipple means of said outer annular housing means.

7. The check valve assembly of claim 6 further comprising:

locking dog means disposed within a portion of the irregular bore of the shear case means of said outer annular housing means and slidably engaging the end portion of the shear mandrel means secured to one end of the sealing mandrel means; and locking dog cavity means located in the irregular exterior surface of the shear mandrel means aft of the end of the shear mandrel means secured to the one end of the sealing mandrel means whereby when said sliding annular mandrel means moves from the first position in said outer annular housing means, which allows communication through said second apertures from the bore of said outer annular housing means to the exterior thereof, to a second position within said outer annular housing where communication through the second apertures from the bore of said outer annular housing means to the exterior thereof is prevented by said sliding annular mandrel means, the locking dog means engage the locking dog cavity means to prevent movement of said sliding annular mandrel means from the second position within the outer annular housing means.

8. The check valve assembly of claim 7 wherein said shear means comprise:

first shear sleeve means having a plurality of apertures therein engaging a portion of the irregular exterior surface of said sliding annular mandrel means;

second shear sleeve means having a plurality of apertures therein substantially aligned with the plurality of apertures in the first shear sleeve means engaging a portion of the irregular bore through said outer annular housing means; and shear pin means installed in the plurality of apertures in the first and second shear sleeve means, thereby preventing relative movement of the first shear sleeve means with respect to the second shear sleeve means until a predetermined amount of force is applied to said annular sliding mandrel means, the force being transferred from the portion of the irregular exterior surface of said sliding annular mandrel means to the first shear sleeve means causing the shear pin means to be sheared, thereby allowing relative movement between the first shear sleeve means and the second shear sleeve means.

9. The check valve assembly of claim 1 wherein said check valve seal means comprises:

an elastomeric skirt retained on the exterior of said outer annular housing means blocking the second aperture means of said outer annular housing means, the elastomeric skirt being radially expansible outwardly.

10. The check valve assembly of claim 1 wherein said sliding annular mandrel means comprises a pressure balanced sliding annular mandrel means.

11. A check valve assembly comprising:

outer annular housing means having first and second aperture means through the wall thereof and having an irregular bore therethrough, said outer annular housing means comprising:

annular adapter means having the second aperture means through the wall thereof and an irregular bore therethrough;

annular shear case means having one end thereof secured to one end of the annular adapter means and having an irregular bore therethrough;

annular pressure housing means having one end thereof secured to the other end of the annular shear case means, having the first aperture means through the wall thereof and having an irregular bore therethrough; and annular nipple means having one end secured to the other end of the annular pressure housing means, having an irregular bore therethrough and having longitudinal cavity means located in a portion of the irregular bore;

sliding annular mandrel means having an irregular exterior surface having annular shoulder means thereon disposed between the first and second aperture means through said outer annular housing means, said sliding annular mandrel means being slidably disposed in a first position within the bore of said outer annular housing means in sealing engagement therewith having the annular shoulder means of said sliding annular mandrel means communicating with the first aperture means of said outer annular housing means while the bore of said sliding annular mandrel means communicates with the second aperture means of said outer annular housing means, said sliding annular mandrel means comprising:

annular sealing mandrel means having an irregular exterior surface thereon; and shear mandrel means secured to one end of the annular sealing mandrel means, the shear mandrel means having an irregular exterior surface thereon, having shear means abutment means on the end of the annular shear mandrel means secured to the annular sealing mandrel means, having annular shoulder means on the irregular exterior surface thereof and having lug means on the other end of the shear mandrel means, the lug means slidably engaging the longitudinal cavity means located in a portion of the irregular bore of the annular nipple means of said outer annular housing means;

check valve seal means retained on the exterior of said outer annular housing means blocking the second aperture means of said outer annular housing means, said check valve seal means allowing communication from the bore of said outer annular housing means to the exterior thereof but preventing communication from the exterior of said outer annular housing means to the bore thereof, said check valve seal means comprising:

an elastomeric skirt retained on the exterior of said outer annular housing means blocking the second aperture means to said outer annular housing means, the elastomeric skirt being radially expansible outwardly; and shear means disposed within said outer annular housing means having a first portion thereof engaging a portion of the irregular exterior surface of said sliding annular mandrel means and having a second portion thereof engaging a portion of the irregular bore through said outer annular housing means, said shear means initially preventing movement of said sliding annular mandrel means with respect to said outer annular housing means when said sliding annular mandrel means is disposed within said outer annular housing means in a first position therein until a predetermined amount of force is applied to said annular sliding mandrel means, said shear means comprising:

first shear sleeve means having a plurality of apertures therein and engaging a portion of the irregular exterior surface of said sliding annular mandrel means;

second shear sleeve means having a plurality of apertures therein substantially aligned with the plurality of apertures in the first shear sleeve means and engaging a portion of the irregular bore through said outer annular housing means; and shear pin means installed in the plurality of apertures in the first and second shear sleeve means, thereby preventing relative movement of the first shear sleeve means with respect to the second shear sleeve means until a predetermined amount of force is applied to said annular sliding mandrel means, the force being transferred from the portion of the irregular exterior surface of said sliding annular mandrel means to the first shear sleeve means causing the shear pin means to be sheared, thereby allowing relative movement between the first shear sleeve means and the second shear sleeve means.

12. The check valve assembly of claim 11 further comprising:

locking dog means disposed within a portion of the irregular bore of the shear case means of said outer annular housing means and slidably engaging the end portion of the shear mandrel means secured to one end of the sealing mandrel means; and locking dog cavity means located in the irregular exterior surface of the shear mandrel means aft of the end of the shear mandrel means secured to the one end of the sealing mandrel means;

whereby when said sliding annular mandrel means moves from the first position in said outer annular housing means, which allows communication through said second apertures from the bore of said outer annular housing means to the exterior thereof, to a second position within said outer annular housing where communication through the second apertures from the bore of said outer annular housing means to the exterior thereof is prevented by said sliding annular mandrel means, the locking dog means engage the locking dog cavity means to prevent movement of said sliding annular mandrel means from the second position within the outer annular housing means.

13. The check valve assembly of claim 11 wherein said sliding annular mandrel means comprises a pressure balanced sliding annular mandrel means.

14. In a drill stem testing string having a closed tester valve and a check valve assembly therebelow, the drill stem testing string being inserted into a fluid filled well bore having a preset packer therein, the check valve assembly relieving the fluid trapped between the preset packer and the closed tester valve as the testing string is being inserted into the preset packer, the check valve assembly comprising:

outer annular housing means having first and second aperture means through the wall thereof and having an irregular bore therethrough;

sliding annular mandrel means having an irregular exterior surface having annular shoulder means thereon disposed between the first and second aperture means through said outer annular housing means, said sliding annular mandrel means being slidably disposed in a first position within the bore of said outer annular housing means in sealing engagement therewith having the annular shoulder means of said sliding annular mandrel means communicating with the first aperture means of said outer annular housing means while the bore of said sliding annular mandrel means communicates with the second aperture means of said outer annular housing means;

check valve seal means retained on the exterior of said outer annular housing means blocking the second aperture means of said outer annular housing means, said check valve seal means allowing communication from the bore of said outer annular housing means to the exterior thereof but preventing communication from the exterior of said outer annular housing means to the bore thereof; and shear means disposed within said outer annular housing means having a first portion thereof engaging a portion of the irregular exterior surface of said sliding annular mandrel means and having a second portion thereof engaging a portion of the irregular bore through said outer annular housing means, said shear means initially preventing movement of said sliding annular mandrel means with respect to said outer annular housing means when said sliding annular mandrel means is disposed within said outer annular housing means in a first position therein until a predetermined amount of force is applied to said annular sliding mandrel means.

15. The check valve assembly of claim 14 further comprising:

locking dog means disposed within said outer annular housing means, said locking dog means allowing movement of said sliding annular mandrel means from the first position within said outer annular housing means.

16. The check valve assembly of claim 15 further comprising:

locking dog cavity means disposed on said sliding annular mandrel means, said locking dog cavity means being disposed on said sliding annular mandrel means to allow movement of said sliding annular mandrel means from the first position within said annular housing means to a second position within said annular mandrel means, whereby said locking dog means engage said locking dog cavity means to prevent movement of said sliding annular mandrel means from the second position within said sliding annular housing means.

17. The check valve assembly of claim 16 further comprising:

lug means on the exterior surface of one end of said sliding annular mandrel means; and longitudinal cavity means located in a portion of the irregular bore of said outer annular housing means slidably receiving said lug means of said sliding annular mandrel means therein.

18. The check valve assembly of claim 14 wherein said outer annular housing means comprises:

annular adapter means having the second aperture means through the wall thereof and an irregular bore therethrough;

annular shear case means having one end thereof secured to one end of the annular adapter means, the annular shear case means having an irregular bore therethrough;

annular pressure housing means having one end thereof secured to the other end of the annular shear case means, having the first aperture means through the wall thereof and having an irregular bore therethrough, the annular pressure housing means receiving the annular shoulder means of said sliding annular mandrel means therein; and annular nipple means having one end secured to the other end of the annular pressure housing means, having an irregular bore therethrough and having longitudinal cavity means located in a portion of the irregular bore.

19. The check valve assembly of claim 18 wherein said sliding mandrel means comprises:

annular sealing mandrel means having an irregular exterior surface thereon; and shear mandrel means secured to one end of the annular sealing mandrel means, the shear mandrel means having an irregular exterior surface thereon, having shear means abutment means on the end of the annular shear mandrel means secured to the annular sealing mandrel means, having annular shoulder means on the irregular exterior surface thereof and having lug means on the other end of the shear mandrel means, the lug means slidably engaging the longitudinal cavity means located in a portion of the irregular bore of the annular nipple means of said outer annular housing means.

20. The check valve assembly of claim 19 further comprising:

locking dog means disposed within a portion of the irregular bore of the shear case means of said outer annular housing means and slidably engaging the end portion of the shear mandrel means secured to one end of the sealing mandrel means; and locking dog cavity means located in the irregular exterior surface of the shear mandrel means aft of the end of the shear mandrel means secured to the one end of the sealing mandrel means;

whereby when said sliding annular mandrel means moves from the first position in said outer annular housing means, which allows communication through said second apertures from the bore of said outer annular housing means to the exterior thereof, to a second position within said outer annular housing where communication through the second apertures from the bore of said outer annular housing means to the exterior thereof is prevented by said sliding annular mandrel means, the locking dog means engage the locking dog cavity means to prevent movement of said sliding annular mandrel means from the second position within the outer annular housing means.

21. The check valve assembly of claim 20 wherein said shear means comprise:

first shear sleeve means having a plurality of apertures therein engaging a portion of the irregular exterior surface of said sliding annular mandrel means;

second shear sleeve means having a plurality of apertures therein substantially aligned with the plurality of apertures in the first shear sleeve means engaging a portion of the irregular bore through said outer annular housing means; and shear pin means installed in the plurality of apertures in the first and second shear sleeve means, thereby preventing relative movement of the first shear sleeve means with respect to the second shear sleeve means until a predetermined amount of force is applied to said annular sliding mandrel means, the force being transferred from the portion of the irregular exterior surface of said sliding annular mandrel means to the first shear sleeve means causing the shear pin means to be sheared, thereby allowing relative movement between the first shear sleeve means and the second shear sleeve means.

22. The check valve assembly of claim 14 wherein said check valve seal means comprises:

an elastomeric skirt retained on the exterior of said outer annular housing means blocking the second aperture means of said outer annular housing means, the elastomeric skirt being radially expansible outwardly.

23. The check valve assembly of claim 14 wherein said sliding annular mandrel means comprises a pressure balanced sliding annular mandrel means.

24. In a drill stem testing string having a closed tester valve and a check valve assembly therebelow, the drill stem testing string being inserted into a fluid filled well bore having a preset packer therein, the check valve assembly relieving the fluid trapped between the preset packer and the closed tester valve as the testing string is being inserted into the preset packer, the check valve assembly comprising:

outer annular housing means having first and second aperture means through the wall thereof and having an irregular bore therethrough, said outer annular housing means comprising:

annular adapter means having the second aperture means through the wall thereof and an irregular bore therethrough;

annular shear case means having one end thereof secured to one end of the annular adapter means and having an irregular bore therethrough;

annular pressure housing means having one end thereof secured to the other end of the annular shear case means, having the first aperture means through the wall thereof and having an irregular bore therethrough; and annular nipple means having one end secured to the other end of the annular pressure housing means, having an irregular bore therethrough and having longitudinal cavity means located in a portion of the irregular bore;

sliding annular mandrel means having an irregular exterior surface having annular shoulder means thereon disposed between the first and second aperture means through said outer annular housing means, said sliding annular mandrel means being slidably disposed in a first position within the bore of said outer annular housing means in sealing engagement therewith having the annular shoulder means of said sliding annular mandrel means communicating with the first aperture means of said outer annular housing means while the bore of said sliding annular mandrel means communicates with the second aperture means of said outer annular housing means, said sliding annular mandrel means comprising:

annular sealing mandrel means having an irregular exterior surface thereon; and shear mandrel means secured to one end of the annular sealing mandrel means, the shear mandrel means having an irregular exterior surface thereon, having shear means abutment means on the end of the annular shear mandrel means secured to the annular sealing mandrel means, having annular shoulder means on the irregular exterior surface thereof and having lug means on the other end of the shear mandrel means, the lug means slidably engaging the longitudinal cavity means located in a portion of the irregular bore of the annular nipple means of said outer annular housing means;

check valve seal means retained on the exterior of said outer annular housing means blocking the second aperture means of said outer annular housing means, said check valve seal means allowing communication from the bore of said outer annular housing means to the exterior thereof but preventing communication from the exterior of said outer annular housing means to the bore thereof, said check valve seal means comprising:

an elastomeric skirt retained on the exterior of said outer annular housing means blocking the second aperture means of said outer annular housing means, the elastomeric skirt being radially expansible outwardly; and shear means disposed within said outer annular housing means having a first portion thereof engaging a portion of the irregular exterior surface of said sliding annular mandrel means and having a second portion thereof engaging a portion of the irregular bore through said outer annular housing means, said shear means initially preventing movement of said sliding annular mandrel means with respect to said outer annular housing means when said sliding annular mandrel means is disposed within said outer annular housing means in a first position therein until a predetermined amount of force is applied to said annular sliding mandrel means, said shear means comprising:

first shear sleeve means having a plurality of apertures therein and engaging a portion of the irregular exterior surface of said sliding annular mandrel means;

second shear sleeve means having a plurality of apertures therein substantially aligned with the plurality of apertures in the first shear sleeve means and engaging a portion of the irregular bore through said outer annular housing means; and shear pin means installed in the plurality of apertures in the first and second shear sleeve means, thereby preventing relative movement of the first shear sleeve means with respect to the second shear sleeve means until a predetermined amount of force is applied to said annular sliding mandrel means, the force being transferred from the portion of the irregular exterior surface of said sliding annular mandrel means to the first shear sleeve means causing the shear pin means to be sheared, thereby allowing relative movement between the first shear sleeve means and the second shear sleeve means.

25. The check valve assembly of claim 24 further comprising:

locking dog means disposed within a portion of the irregular bore of the shear case means of said outer annular housing means and slidably engaging the end portion of the shear mandrel means secured to one end of the sealing mandrel means; and locking dog cavity means located in the irregular exterior surface of the shear mandrel means aft of the end of the shear mandrel means secured to the one end of the sealing mandrel means;

whereby when said sliding annular mandrel means moves from the first position in said outer annular housing means, which allows communication through said second apertures from the bore of said outer annular housing means to the exterior thereof, to a second position within said outer annular housing where communication through the second apertures from the bore of said outer annular housing means to the exterior thereof is prevented by said sliding annular mandrel means, the locking dog means engage the locking dog cavity means to prevent movement of said sliding annular mandrel means from the second position within the outer annular housing means.

26. The check valve assembly of claim 24 wherein said sliding annular mandrel means comprises a pressure balanced sliding annular mandrel means.

* * * * *